US006745406B2

(12) United States Patent
Ruane

(10) Patent No.: US 6,745,406 B2
(45) Date of Patent: Jun. 8, 2004

(54) RECONFIGURABLE ORTHOPEDIC SLEEP AIDS

(76) Inventor: Joseph J. Ruane, 818 Hensel Woods Rd., Columbus, OH (US) 43230-3876

( * ) Notice: Subject to any disclaimer, the term of this patent is extended or adjusted under 35 U.S.C. 154(b) by 253 days.

(21) Appl. No.: 10/056,692

(22) Filed: Jan. 24, 2002

(65) Prior Publication Data

US 2003/0135917 A1 Jul. 24, 2003

(51) Int. Cl.[7] ..... A41D 13/00
(52) U.S. Cl. ..... 2/465; 2/23
(58) Field of Search ..... 2/23, 465, 467, 2/92, 267, 227, 228, 238, 22, 24, 16, 69, 911, 455, 456, 46, 2.5, 62, 242, 919; 602/23, 26, 61; 5/630, 632, 648, 652

(56) References Cited

U.S. PATENT DOCUMENTS

| | | | | | |
|---|---|---|---|---|---|
| 4,513,449 | A | * | 4/1985 | Donzis | 2/462 |
| 4,641,641 | A | | 2/1987 | Strock | |
| 4,700,407 | A | * | 10/1987 | Mattila | 2/465 |
| 4,971,334 | A | * | 11/1990 | Stewart | 273/348.4 |
| 5,048,542 | A | | 9/1991 | Murray | |
| 5,105,473 | A | * | 4/1992 | Valtakari | 2/461 |
| 5,168,576 | A | | 12/1992 | Krent et al. | |
| 5,423,087 | A | | 6/1995 | Krent et al. | |
| 5,497,511 | A | * | 3/1996 | Zade | 2/22 |
| 5,636,377 | A | | 6/1997 | Wiener | |
| 5,689,836 | A | | 11/1997 | Fee et al. | |
| 5,717,997 | A | * | 2/1998 | Garcia | 2/23 |
| 5,732,412 | A | * | 3/1998 | Holden | 2/23 |
| 6,195,809 | B1 | | 3/2001 | Garcia | |
| 6,408,446 | B1 | * | 6/2002 | Carrington | 2/465 |

* cited by examiner

*Primary Examiner*—Tejash Patel
(74) *Attorney, Agent, or Firm*—Sean M. Casey

(57) ABSTRACT

A reconfigurable orthopedic sleep aid that is adapted to be worn by a patient about the hips and legs, a knee, a portion of the back, a shoulder, and or another symptomatic anatomical location for injury prevention, trauma amelioration, and optimized comfort, and when applicable for reduced periods of post-trauma convalescence. The sleep aid incorporates a stretchable, stretchably conformable, or loose fitting garment, such as a girdle or trouser that is adapted to be worn during sleep. The garment includes one or more attachments and bears a coordinate indicia pattern, and orientation indicia that can correspond to an anatomical location of the patient such as a greater trocanter, a posterior superior iliac crest, a coccyx, an anterior ventral navel-aligned position, a medial or lateral patella border, a lateral or medial compartment of a respective inferior or superior knee joint, and a hamstring tendon, and combinations thereof. The sleep aid also includes a substantially compressible annular pad or pads formed with a generally toroidal or wedge-shaped cross section. The pads are configured to connect to the attachment near to the anatomical location to distribute the contact stress away from the symptomatic location and to surrounding tissues. The pad(s) also incorporate reference indicia adapted to cooperate with the coordinate indicia pattern to establish placement positions on the garment. The attachment may incorporate a hook and loop type fastener assembly and the pad(s) may be formed with generally tapered edges about inner and outer peripheries that circumscribe the annular portion of the pad(s).

20 Claims, 5 Drawing Sheets

RECONFIGURABLE ORTHOPEDIC SLEEP AIDS

TECHNICAL FIELD

The present invention pertains to a system of orthopedic rest aids, more particularly, to a system of orthopedic garments used to anchor protective or supportive pads in proximity to symptomatic joints during rest.

BACKGROUND OF THE INVENTION

The development of arthritis, chronic tendonitis, bursitis, and other chronic degenerative joint diseases, to varying degrees, is an inevitable part of the aging process. Additionally, disorders of joint alignment can increase pain syndromes, which can often occur at a distance from the misaligned joint. Such joint disorders can arise not only from aging, but also from injuries, post-trauma malconvalesence, congenital deformations, and biochemical and hormonal changes, fluctuations, instability such as that due to pregnancy and to otherwise anomalous conditions. In addition to the well-known pain these conditions impose on individuals engaged in routine and daily activities, the conditions are an often-underappreciated cause of sleep deprivation. Discomfort in the joint regions can cause sleep disturbances and frequent awakening due to localized pain.

For example, a variety of degenerative joint conditions can cause pain that results in sleep deprivation. These conditions are worsened by the degeneration and loss of intracorporeal tissue, sinovia, and related structures, which occurs with aging, and which leaves the bony structures of various joints, less protected and therefore more susceptible to injury from the effects from otherwise ordinary stresses and movement. Pain is frequently addressed with medication that causes undesirable side effects, which can include serious gastrointestinal bleeding and other disturbances that affect appetite and food intake. The resulting cycle of pain, medication, and side effects ultimately causes poor health, decreased quality of life, and increased medical spending. Lack of sleep can further instigate and exacerbate other health problems, such as hypertension and stress syndromes.

In order to avoid the complications and side effects attendant to systemic drug treatments, pain syndromes are sometimes treated with mechanical appliances, such as various pad type devices. Padding can reduce the symptoms of many joint conditions, without the side effects attendant to systemic drug treatments. However, common problems exist with commonly available padding including the difficulties inherent in the need to accommodate physiological idiosyncrasies of every symptomatic individual. Such customized padding requirements are further complicated with the need to predictably and reproducibly shape and place appropriate padding that addresses the particular symptoms, the need to adjust and reproduce the position of the padding as symptoms are relieved and as they change, and the need to anchor the padding to resist displacement during normal body motion during sleep. In other words, the pad-type appliances most commonly known in the prior art restrict the ability of the individual and their health care provider to properly obtain or prescribe padding that adequately meets the needs of the physique and symptoms of the individual without excessive costs and considerable inconvenience. Moreover, current pads and methods for use and related devices are often provided without complementary education being provided to the symptomatic individual as to how to adjust and optimize the padding for optimal results, or to accommodate changes in symptoms.

Such limitations in the prior art devices and methods can be better appreciated with reference to selected examples. Attempts to protect and avoid injury to joints have been made in the form of protective garments that are designed to surround and cushion joints, including, for example, the hip joint. One such attempt is described in U.S. Pat. No. 6,195,809 to Garcia, which describes padding that is limited to a trochanteric pad sewn into an outside pocket on the lateral aspect of a close fitting garment. Garcia's proposed arrangement is restricted in application because it is not possible to move the pad or to change the thickness or shape of the pad without effecting a complete change in garments. Similarly limited fixed pad configurations also appear in U.S. Pat. No. 5,689,836 to Fee et al.; U.S. Pat. No. 5,636,377 to Wiener; and U.S. Pat. Nos. 5,168,576 & 5,423,087 to Krent et al.

Attempts at adjustability of joint pads have been illustrated in certain prior art illustrations, which fall short of achieving the more desirable capabilities. For example, Wiener '377 teaches discrete sections of opposing hook and pile fasteners on a garment and a pad. However, the Wiener arrangement restricts the possible variety of pad configurations and does not allow but a limited number of adjustment positions. The variable anchoring system taught by Murray in U.S. Pat. No. 5,048,542 has many shortcomings including that it depends on constriction about a joint to provide anchoring, and that it does not offer easily predictable or reproducible adjustments. The method taught in U.S. Pat. No. 4,641,641 to Strock is anchored by adhesives to the skin, which makes it unsuitable where multiple adjustments are required, or for long-term use, especially in applications involving pressure sores, and in that it also lacks a reproducible system for adjustment.

Properly positioned padding can support the joints in a manner to alter biomechanical anatomical relationships and can frequently decrease pain at intracorporeal locations distal to the padding. For example, low back pain is an exceedingly common musculoskeletal affliction. Low back pain is frequently caused by compression of the posterior elements of the spine, or by posterior shift of vertebral disk material. Mechanical lower back pain often responds to postural correction and muscle balancing, which decreases excessive loading forces through the posterior elements of the lumbar spine. Often, the amount of mechanical correction needed to reverse these stresses is very small. Reversal of lordosis by only a few millimeters can produce very satisfying results and is the goal of abdominal strengthening, which is commonly used to treat this problem. This is often achieved through physical therapy and exercise, but due to a dismal long-term adherence to exercise programs by most patients, such individuals soon experience a return of symptoms.

Common methods of assisting with positional correction of mechanical low back pain include various appliances, most often pillows, under the knees and back to address the discomfort. Using such appliances at night may result in initial comfort, but a common problem is that as soon as the individual rolls over or assumes a non-supine position, the appliance shifts and even a return to the original position does not restore the benefit.

The present invention addresses these and many other shortcomings in the current art. The contemplated orthopedic rest aids according to the instant invention enable easily customizable, secure, and reproducible anatomical compatibility and orientation in a collections of features and benefits that results in an apparatus that can be fine-tuned for each symptomatic individual by both the health care professional and the patient without undue difficulty or expense. The preferred orthopedic rest aids are lightweight, reconfigurable, securely attached to, and yet easily adjusted on the garment. Any of a wide number of shape adjustable pads and donning arrangements is possible with the embodiments according to the instant invention.

The orthopedic rest aids according to the present invention are useful in both padding vulnerable joints and in supporting joints and constituent structures and elements to address symptomatic and undesirable biomechanical relationships. Finally, as can be understood by those having ordinary skill in the art, the various new and novel configurations, variations, and modifications of the preferred embodiments can be configured to meet a wide variety of specific anatomical idiosyncrasies and as well as any number of symptom complexes and preferred treatment regimens.

What has been needed but heretofor unavailable, is an orthopedic rest aid that is not only compatible for use with the largest number of possible patient anatomies and treatment indications, but which is also available in a form that maximizes patient convenience and comfort without undue expense, and which minimizes the intervention and maintenance required by health care professionals who are in high demand. Moreover, the preferred apparatus should be easily adapted to perform well with any of the aforementioned types of anomalous conditions including those described above and contemplated herein.

The present invention meets these and other needs by enabling the patient to overcome pain and discomfort for purposes of improving quality of sleep without the need for expensive and inconvenient or ineffective padding systems and appliances. The devices according to the present invention accomplish this with a minimum of complexity and with a maximum of flexibility. The various embodiments of the present invention disclosed herein are readily adapted for ease of customization, reconfigurability, replacement, and user optimization, in addition to simplicity of manufacture, low producibility costs in view of the prior art, and immediate compatibility with most common types of maligned joint induced pain and symptom complexes.

SUMMARY OF INVENTION

In its most general sense, the present invention contributes a novel and useful advance to the field of art of orthopedic rest aids, and more particularly such devices having the form of comfortable sleep compatible appliances and integrated sleep wear, by offering a new and innovative capability that until now has been unavailable. In one configuration, the device according to the instant invention is directed to a reconfigurable orthopedic sleep aid that is adapted to be worn by a patient about the hips and at least one thigh. The sleep aid preferably includes a garment that is adapted to substantially surround the hip and at least one thigh and that has at least one attachment. The garment also bears an imprinted coordinate indicia pattern and one or more imprinted orientation indicia. The indicia generally correspond to an anatomical location of the patient, which includes for example, a greater trocanter of the hip, a posterior superior iliac crest, a coccyx, and an anterior ventral position medially aligned with the navel, and combinations thereof.

The sleep aid also preferably includes at least one substantially compressible pad that has a generally annular profile and a generally toroidal cross sectional profile. The pad is attached to or carried from the attachment on the garment near to the greater trochanteric area of the hip of the patient. When the patient assumes a lateral recumbent position, this arrangement serves to distribute the weight of the patient away from the greater trocanter and to surrounding tissues. The pad also preferably bears reference indicia that are adapted to cooperate with the coordinate indicia pattern on the garment whereby the patient can easily and reproducibly establish at least one preferred placement position for the pad on the garment.

The sleep aid also preferably includes an interior surface of the garment that is conformally formed as the at least one attachment. For example, the entire interior surface can be an attachment surface that is adapted to repositionably carry the pad. Also, the attachment is substantially formed from a dermally comfortable pile material compatible for use as a loop portion of a hook and loop type fastener assembly. To attach to the pile material, the pad further preferably incorporates a hook portion of the fastener assembly. Also, for non-ambulatory patients, or for incontinent patients that must don additional excretion absorbing materials, the garment is further modified to have edges defining an opening that is positioned about the perineal region of the patient.

In the presently described embodiment, the reconfigurable orthopedic sleep aid also preferably incorporates two substantially compressible pads that have a generally annular profile and a generally toroidal cross sectional profile. The pads are preferably attached to and or carried from the attachment of the garment near the respective greater trochanteric areas of the hips. For even more improved comfort, the pads can be further formed with generally tapered edges about inner and outer peripheries, which can be adapted to better distribute weight away from the region of concern and to surrounding tissues. In further variations of the instant embodiment, the preferred pads may be formed to have a generally cycloidal profile that defines an interior recess having a generally elliptical profile.

In a modification to any of the preceding arrangements, the reconfigurable orthopedic sleep aid of the instant invention can be adapted to be worn by a patient about the hips and legs. This modification preferably includes a generally loose fitting trouser garment that is adapted to be worn by the patient during sleep. The garment includes an attachment portion that is conformally formed on an interior or exterior surface of the garment. A coordinate indicia pattern and one or more orientation indicia maybe imprinted on the garment and would preferably correspond generally to an anatomical location of the patient for positioning of the garment as described above. The sleep aid also preferably includes at least one substantially compressible pad. The preferred pad has a generally annular profile and a generally toroidal cross sectional profile, and is attached to and or carried from the attachment portion on the garment. In one exemplary arrangement, the pad is positioned near the greater trochanteric area of the hip of the patient. When the patient assumes a lateral recumbent position, the pad functions to distribute the weight of the patient away from the greater trocanter and to surrounding tissues. The preferred pad also preferably bears reference indicia that are adapted to cooperate with the coordinate indicia pattern imprinted on the garment to establish at least one easily reproducible and easy to locate placement position on the garment.

The sleep aid according to the instant invention may also be directed to include a garment as described that also is adapted to include at least one generally wedge shaped and substantially compressible pad configured to be carried from the attachment. In variation of preceding embodiments, the wedge shaped pad is attached to the garment proximate the gluteal fold of the patient to, when the patient assumes a supine recumbent position, effect posterior tilt of the pelvis to decrease the lordotic position of the back. As with preceding embodiments and variations, the at least one wedge also preferably includes reference indicia that are adapted to cooperate with the coordinate indicia pattern imprinted on the garment, which enable ease and reproducibility of placement on the garment. The present variation also further contemplates modifications wherein two generally wedge shaped and substantially compressible pads are adapted to be attached to and carried from the garment near the respective gluteal folds. This arrangement is also directed to use in the configuration that includes the reconfigurable orthopedic sleep aid being adapted to be worn by a patient about the hips and legs. In this further alternative arrangement, the garment is configured as a generally loose fitting trouser that adapted to be worn by the patient during recuperation or sleep.

In yet other modifications to any of the preceding embodiments, the reconfigurable orthopedic sleep aid of the instant invention is also adapted to be worn by a patient about a knee joint. In this configuration, a garment is adapted to substantially conform to and surround the knee joint and to have at least one attachment. This garment also preferably is imprinted with a coordinate indicia pattern and one or more orientation indicia that generally correspond to an anatomical location of the patient. In this variation, the indicia are adapted and positioned to correspond with, for example, a medial and a lateral border of the patella, a lateral and a medial compartment of a respective inferior and superior knee joint, and a hamstring tendon of the knee joint, and combinations thereof. As with preceding embodiments, this alternative configuration incorporates at least one substantially compressible pad that is formed with a generally annular profile and a generally toroidal cross sectional profile. The pad is preferably configured for attachment to the attachment on the garment so that it is worn about medio-lateral aspect of the knee joint. As worn and when the patient assumes a lateral recumbent position, the pad distributes the weight of the patient away from the medio-lateral aspect, to surrounding tissues. Preferably, the pad also bears reference indicia that are adapted to cooperate with the coordinate indicia pattern to establish at least one placement position on the garment that is easy for the patient to identify, and that is easy to reproduce, once the preferred location is established by the patient and or the care giver. This variation may also further incorporate any of the preceding additional modifications and arrangements.

The reconfigurable orthopedic sleep aid according to the instant invention also further incorporates a generally loose fitting trouser garment that is adapted to be worn by the patient during sleep, and which is adapted to alleviate discomfort of one or more knee joint related anomalies. This configuration includes an attachment portion that is conformally formed on a surface of the garment and includes one or more orientation indicia and a coordinate indicia pattern that generally corresponds to a predetermined anatomical location of the patient. The anatomical location can include, for example, a medial and a lateral border of the patella, a lateral and a medial compartment of a respective inferior and superior knee joint, and a hamstring tendon of the knee joint, and combinations thereof. The instant embodiment also includes at least one substantially compressible pad having a generally annular profile and a generally toroidal cross sectional profile with tapered inner and outer edges. The pad is also preferably configured to be attached to and carried from the attachment portion of the garment near the predetermined anatomical location to distribute the weight of the patient away from the predetermined location and to surrounding tissues, when the patient assumes a lateral recumbent position. The preferred pad is also preferably imprinted with reference indicia adapted to cooperate with the coordinate indicia pattern on the garment for easy and reproducible placement on the garment.

The preceding variations, modifications, and alterations of the various preferred embodiments may be used either alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, wherein like reference numerals, and like numerals with primes, across the several drawings, figures, and views refer to identical, corresponding, or equivalent elements, components, features, and parts:

DETAILED DESCRIPTION OF THE INVENTION

The orthopedic sleep aid device according to the present invention demonstrates a significant advance in the state of the art of orthopedic sleep aids adapted to be compatible with a wide variety of anatomical sizes and shapes for purposes of minimizing or eliminating pain due to anomalous joint symptoms and preferred treatment plans. Of particular note and in contrast to the cumbersome, economically non-viable, and clinically undesirable prior art devices, the instant invention is well-suited for use in ameliorating pain from and in treating causes and symptoms of various disorders of joints and related tissues and anatomical structures. Also, in view of the now possible reconfigurability offered by the instant invention, the patient is no longer limited by the prior art device because the novel and heretofore unavailable device may be easily and continually optimized to maximize comfort and efficacy for ever-changing anatomical, symptomatic, and proposed treatment regimen requirements.

Figure 1:
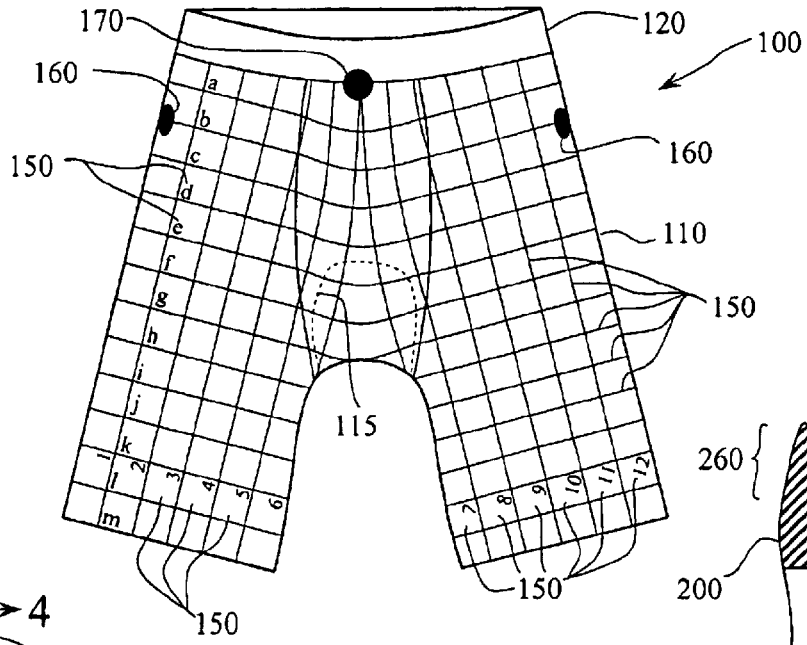
FIG. 1 is a front elevation view, in reduced scale, of an orthopedic rest aid according to the principles of the present invention.
Figure 2:
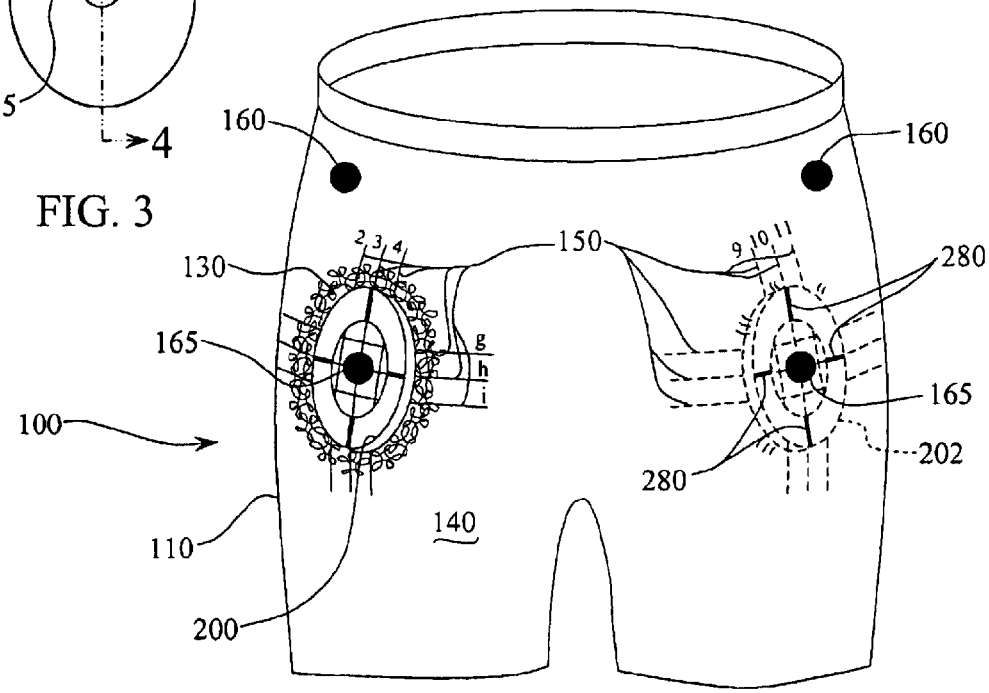
FIG. 2 is an elevated perspective view, in enlarged scale, of the apparatus side of FIG. 1 with certain elements added and removed for clarity.

With reference now to the various figures and specifically to FIGS. 1 and 2, a reconfigurable orthopedic sleep aid 100 is depicted, which is adapted to be worn by a patient (not shown) about the hips and legs. The sleep aid 100 is preferably in the form of either a stretchable close fitting girdle or trouser garment 110. The sleep aid 100 may also take the form of any of a variety of equally suitable loose fitting pajama-type, short or long, pant boxer-style or trouser-style garments, similar to garment 110, and which are also contemplated by the instant invention and well-known to those with skill in the art of sleep wear garment products. The stretchable, stretchably conformable, or loose fit garment 110 may preferably include a waistband 120 that may be formed from an elastic material or that may incorporate a tie cord, either of which can be used to retain the donned garment 110 about the waist of the patient. In alternative arrangements of this configuration and for special purpose situations, such as extremely obese or muscular patients for whom typically configured garments would not suffice, the present invention may also further be adapted to include a waist strap and a single leg strap (not shown) that may be wrapped about the waist and leg of the patient to retain a modified garment similar to the garment 110 shown in the figures, which alternative can be used for the contemplated purposes.

The garment 110 also preferably incorporates at least one attachment portion 130 that may be formed from a pile-type fabric of small thread loops that is compatible with the hook and loop type fastener assembly more commonly known in the art as "Velcro®", which is available from DuPont Corporation, USA. Although shown in FIG. 2 as covering only a portion of an exterior surface 140 of the garment 110, the attachment portion 130 pile or loop material may be conformally formed about the entire exterior, interior, or both surfaces of the garment so as to create an infinitely adjustable configuration as described in more detail below. Preferably, the attachment pile 130 is formed from a dermally compatible and comfortable material that will maximize comfort of the patient during extended periods of contact.

The garment 110 also preferably but optionally bears a coordinate indicia pattern 150 of independently labeled and intersecting lines or other similarly effective indicia that enable precise identification of anatomical locations proximate various locations on the garment 110. One or more anatomical orientation indicia 160, 165, 170 are also preferably imprinted on the garment 110 and correspond to predetermined anatomical locations that are not difficult to locate for the layman patient. For example, as reflected in FIGS. 1 and 2, orientation indicia 160 correspond generally to the posterior superior iliac crest, indicia 165 correspond to the greater trocanter, and indicium 170 (FIG. 1) corresponds generally to an anterior ventral location that may align with the navel or coccyx of the patient (not shown). The indicia 160, 165, 170 are thus useful for purposes of orienting the garment 110 so that the coordinate indicia pattern 150 may be properly positioned for purposes further detailed hereinbelow.

Figure 3:
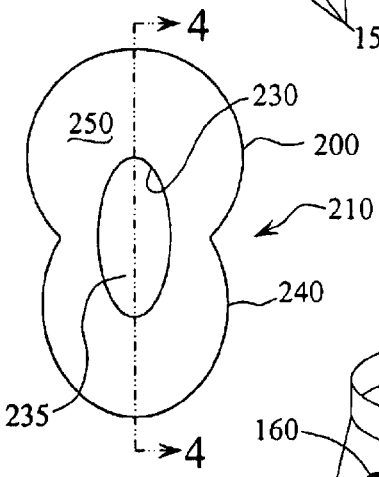
FIG. 3 is a profile top view, rotated and in enlarged scale, of an element of the device of FIG. 2 with certain structure removed for purposes of illustration.
Figure 4:
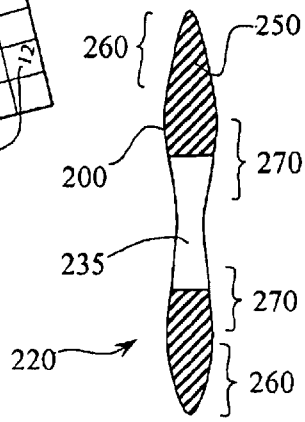
FIG. 4 is a cross-section view, taken along section line 4—4 of FIG. 3, in enlarged scale, of a portion of the component of FIG. 3.

The sleep aid 100 also further preferably includes one or more substantially compressible pad(s) 200, 202 that are formed to have a generally annular profile 210 (FIG. 3) and a generally toroidal cross sectional profile 220 (FIG. 4). The pad(s) 200, 202 also preferably include a hook-type fastener (not shown but within the knowledge of those skilled in the art), of a hook and loop type fastener assembly, that is adapted to join to the attachment 130 on the garment 110. The pad(s) 200, 202 preferably include an inner edge 230 defining a recess 235 and an outer edge 240, the edges 230, 240 together defining an annular portion 250. Even more preferably, the pad(s) 200, 202 are also formed to have a cross-sectional outer taper 260 and inner taper 270 that are adapted to transmit and distribute stresses from the weight of the patient away from the predetermined symptomatic anatomical location described previously. In variations of any of the preceding embodiments, the preferred pad(s) 200, 202 may be formed to have generally rectilinear cross-sectional profiles as well as the tapered cross-sectional profiles illustrated in FIGS. 3 and 4. With specific continued reference to FIG. 4, those with skill in the art may further understand that the preferred configuration of pad(s) 200, 202 may include a plan form exterior profile 210 that follows a generally cycloidal outer peripheral profile, which can further improve the stress distribution away from the symptomatic anatomical location. The pad(s) 200, 202 are preferably further imprinted with reference indicia 280 (FIG. 2) that are adapted to cooperate with the coordinate indicia pattern 150 to establish at least one placement position for the pad(s) 200, 202 on the garment 110.

The pads, including for example pads 200, 202, according to the instant invention may be preferably formed from any number of materials that are effective for the purposes described herein. More specifically, the pads may be preferably formed from a stuffed fabric material, an open or closed cell foam material, a shape memory and contoured foam material, and similar materials. Additionally, the pad and substrate material may be sculpted to conform generally to the anatomical region subject to treatment and to be compatible with any of the variety of garment types contemplated by the present invention.

With continued reference to FIG. 2, it can be understood that the present invention contemplates sleep aid 100 to have pad(s) 200, 202 adapted to be affixed by attachments 130 to the garment 110 preferably on the exterior of the garment 110 as illustrated by pad 200 in FIG. 2, or even more preferably on the interior of the garment 110 as depicted by the hidden line representation of pad 202 (also in FIG. 2). Although not shown in the various figures, those with skill in the art will also appreciate that the pads 200, 202 may be attached or affixed to the garment 110 with variations of attachments (not shown) that are pre-positioned pouches or pockets that can be formed upon or within the garment 110 and which are positioned in anatomically appropriate locations on the garment 110. Furthermore, the instant invention also contemplates modification to any of the preceding embodiments wherein pads, such as pads 200, 202 are permanently or removably attached directly to the garment, such as garment 110 by being sewn thereon, affixed with adhesive, and o or other equally effective means for attachment.

Although shown generally by dashed lines only in FIG. 1, the instant orthopedic sleep aid invention also contemplates modifications of any of the preceding embodiments that incorporate garment edges 115 (FIG. 1), which can be configured to define an opening proximate to the perineal region of the patient. Embodiments that incorporate this variation can be especially compatible for use with non-ambulatory convalescing patients who may require bedpans or other means necessary for the elimination of waste.

Figure 5:
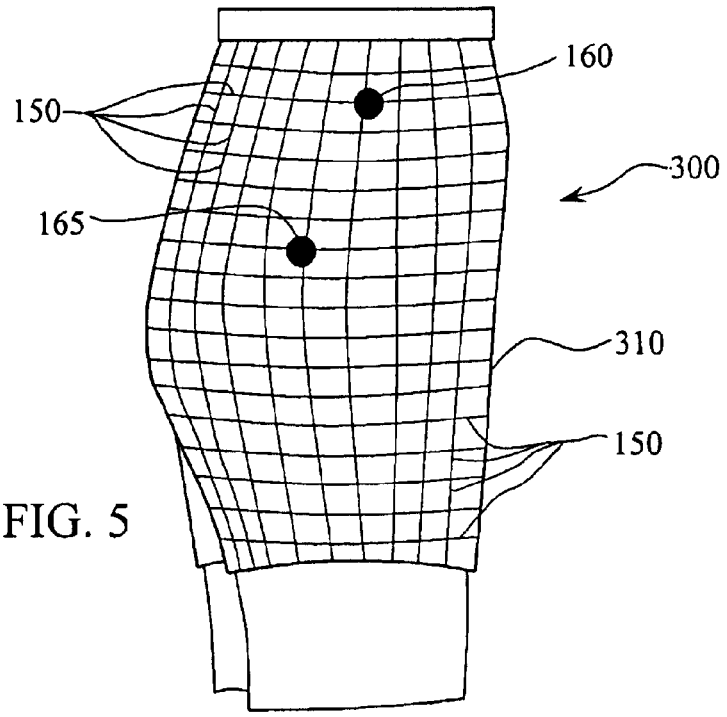
FIG. 5 is a lateral aspect detail view, in enlarged scale, of a variation of the device of FIG. 1 and according to the instant invention.
Figure 6:
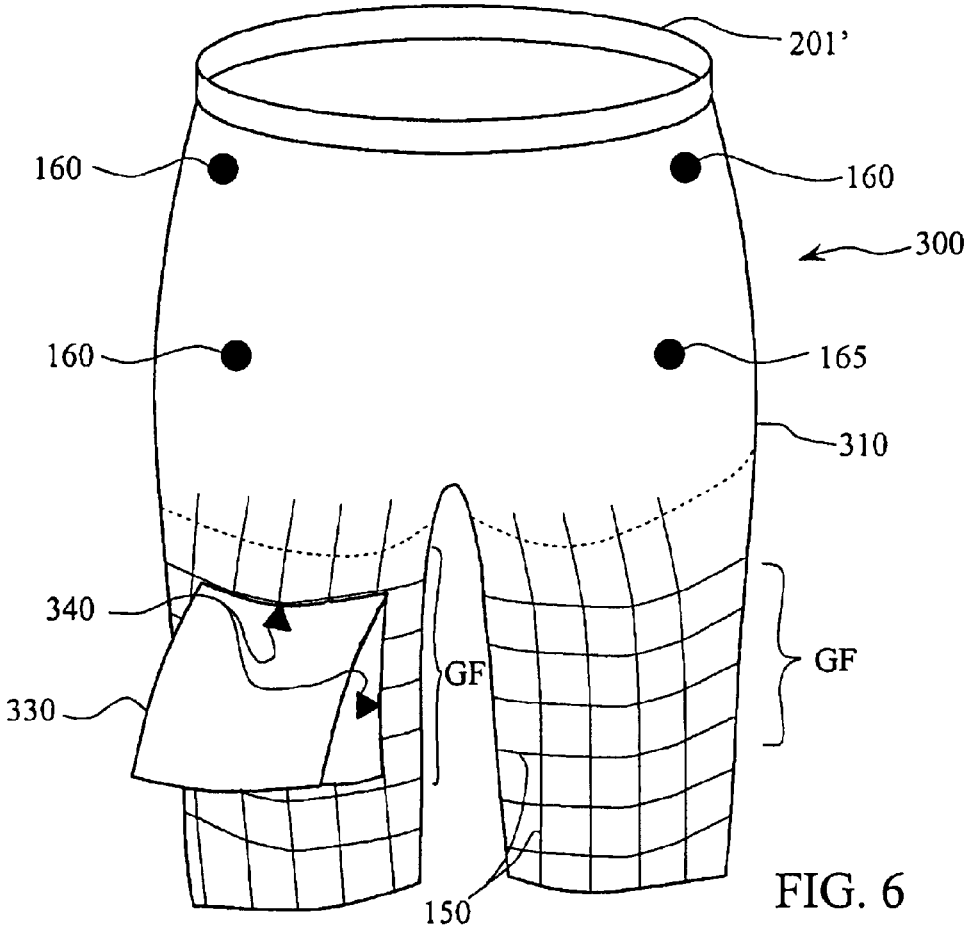
FIG. 6 is a posterior elevation view of the device of FIG. 5.

With reference next to FIGS. 5 and 6, an alternative orthopedic sleep aid 300 according to the principles of the present invention is shown. The sleep aid 300 incorporates a garment 310 that includes any or all of the previously described indicia including coordinate indicia pattern 150, and anatomical orientation indicia 160, 165, and 170. In this alternative arrangement, a pad or pads 330 are incorporated that are formed with a generally wedge shaped cross-sectional profile. With continued reference specifically to FIG. 6, it can be seen that the pad(s) 330 are preferably positioned proximate to the gluteal fold "GF" of the patient to, when the patient assumes a supine recumbent position, effect posterior tilt of the pelvis to decrease the lordotic position of the back. The wedge pad(s) 330 also preferably are imprinted with reference indicia 340 adapted to cooperate with the coordinate indicia pattern 150 to enable precise and reproducible placement on the garment 310. Although not shown in the figures, those with skill in the art can comprehend that the pad(s) 330 may also further preferably incorporate a fastener such as a hook-type portion of a hook and loop fastener assembly.

With reference next to FIGS. 7, 8, 9, and 10, additional modifications and variations of the preceding embodiments are illustrated that are directed to applications suitable for use with a symptomatic knee joint, which joint is denoted generally by reference letter "K". In any of the preferably embodiments described herein, an apparatus or device according to the present invention preferably is adapted to relieve discomfort experienced by a patient who has assumed a lateral recumbent position, and wherein the patient positions the legs whereby the knee joints are registered proximate to one another so that the respective medial compartments would be, but for the use of the instant invention, positioned together. As is known by patients and those skilled in the art alike, such a position is desirable for purposes of comfort and rest. However, the position can result in extreme discomfort, which is usually alleviated once the medial compartments of the knee joint are prevented from contacting one another. Similarly, the preferred apparatus according to the present invention is also well suited for addressing discomfort experienced by a laterally recumbent patient about the lateral compartment of the knee joint K.

Figure 7:
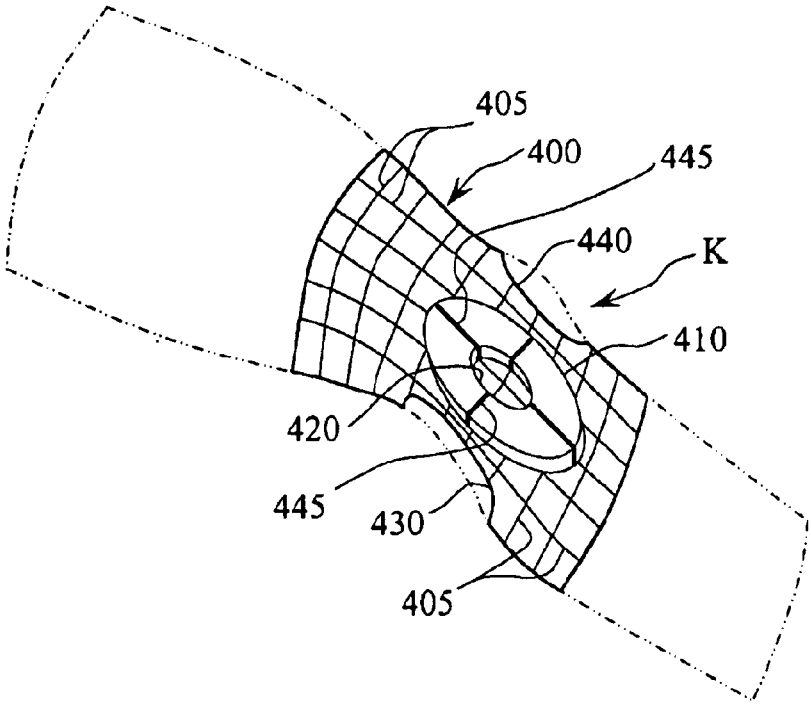
FIG. 7 is a medial (or lateral) aspect elevation view, in reduced scale, of a variation of the embodiments of FIGS. 1 and 5.

In FIG. 7, a garment apparatus 400 is shown that reflects modifications that can be incorporated into of any of the preceding configurations, and which is adapted to address and minimize discomfort of the symptomatic knee joint K. More specifically, the garment 400 is adapted to be wrapped about the joint K, slide onto the leg and positioned about the joint K, or to be incorporated into or as part of a larger snug or loose fit garment, such as a sleep wear garment, or to be configured as a sleeve that can be positioned about the knee joint. The garment 400 preferably includes and carries one or more generally ovoid shaped pad(s) 410 that are preferably formed with a generally centered recess 420. The recess is preferably size and positioned to provide, during use, stress relief to the lateral region of the knee joint K when the patient is lying prone, on her side, and with the knee joints registered generally upon one another. In further variations, garment 400 may also further incorporate a cut out 430 that is positioned proximate to the posterior fossa region of the joint K, and which is sized and configured to provide cooling and to minimize the possibility of discomfort to the knee from any fabric that may bunch up about the posterior fossa area when the knee joint K is folded.

Similarly, the garment 400 may also be formed with another optional cutout portion 440 proximate to the anterior patellar region of the joint K, and which is situated to minimize undue stretching of the fabric of the garment 400 during flexing of the joint K. The garment 400 may also be imprinted with alignment indicia 405 that are preferably configured to establish a garment reference grid or some similar capability that enables the patient to properly align the garment 400 about the knee joint K according to the desired use. The pad(s) 410 are also preferably imprinted with indicia 445 that are adapted to be aligned with the garment indicia 405 so that the pad(s) may be properly aligned about the garment 400 and the thereby to the knee joint K. Although each of these embodiments, variations, and modifications are shown in use and configured for compatibility to address medial compartment knee joint discomfort, those having experience in the art will also understand that a similar configuration can be employed to address similar issues related to the lateral compartment of the knee joint K. Although not shown in the various figures, the instant invention also contemplates the pads 410 being sewn into and or onto garment 400. Further, the pads 410 may be attached to the garment 400 with pouches or pockets (not shown) that may be sewn into the garment 400 and which are sized to removably receive the pads 410.

Figure 8:
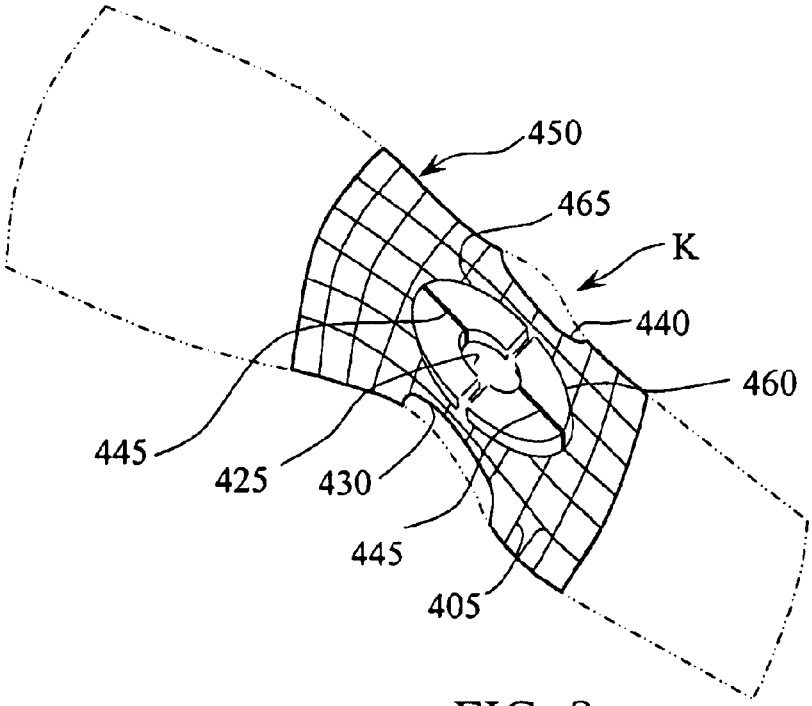
FIG. 8 is a medial (or lateral) aspect elevation view, in reduced scale, of a variation of the embodiment of FIG. 7.
Figure 9:
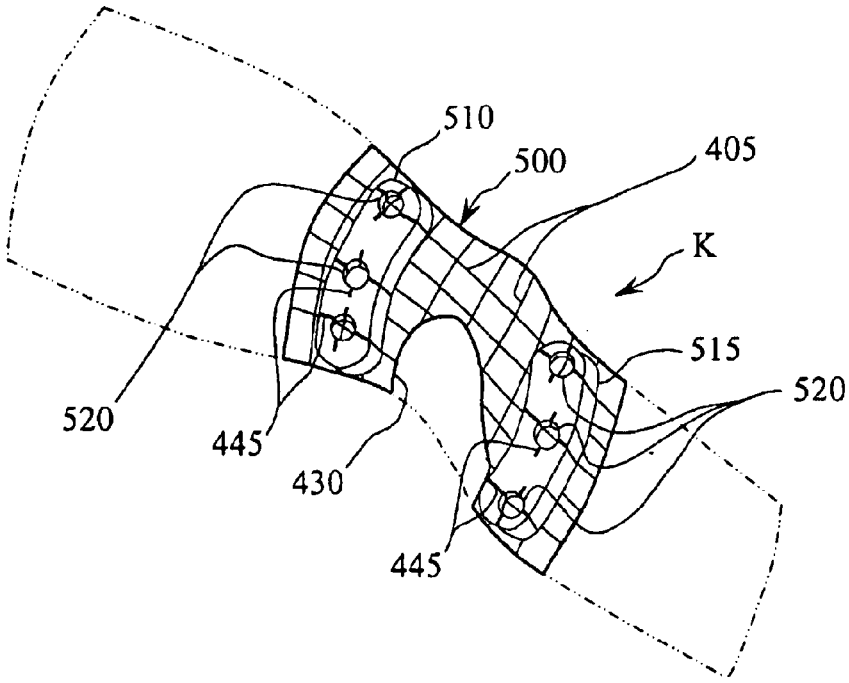
FIGS. 9 and 10 are also medial (or lateral) aspect elevation views, in reduced scale, of modifications of the embodiments of FIGS. 7 and 8.
Figure 10:
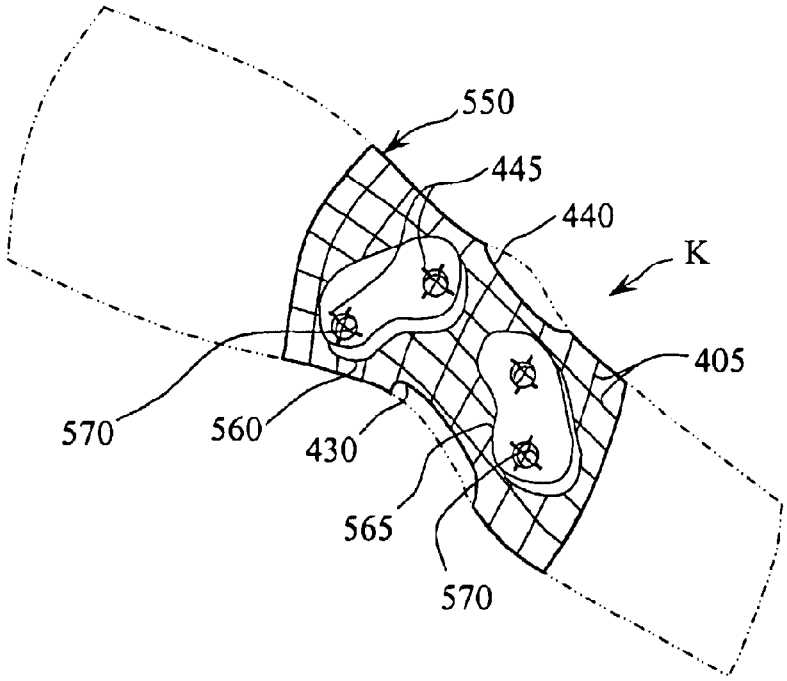
Figure 11:
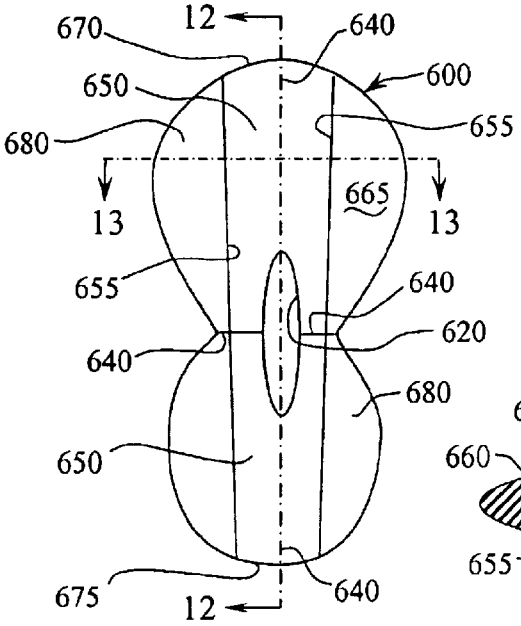
FIG. 11 is a plan view, in reduced scale, of an orthopedic rest aid according to the principles of the present invention.
Figure 13:
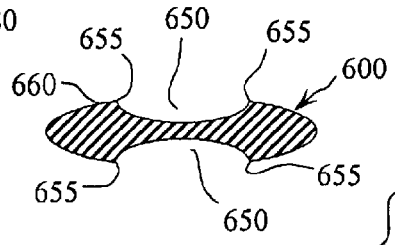
FIG. 13 is a rotated cross-sectional view taken along section line 13—13 in FIG. 11.
Figure 12:
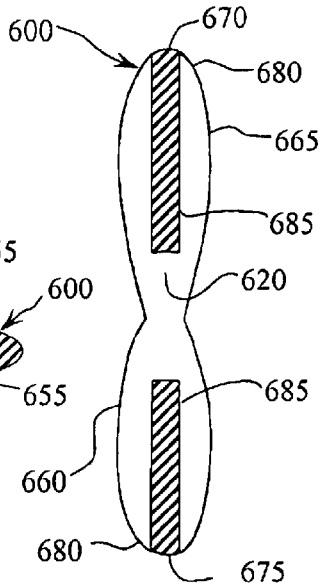
FIG. 12 is a rotated cross-sectional view taken along section line 12—12 in FIG. 11.

In FIG. 8, a garment 450 is illustrated having a multi-part pad with pads 460 and 465 arranged about the garment 450 in similar fashion to previously described configurations. The pads 460, 465 may also father be formed with recesses 425 adapted to provide stress relief to the medial or lateral compartment regions of the knee joint K during use. Similar multi-pad arrangements are also reflected in FIGS. 9, 10. In FIG. 9, garment 500 incorporates pads 510, 515, which may also preferably include stress relief and alignment indicia recesses 520. A garment 550, as shown in FIG. 10, similarly includes a plurality of pads 560, 565 having stress relief and alignment indicia recesses 570.

With continued reference to each of the embodiments, variations, and modifications illustrated in FIGS. 7, 8, 9, and 10, various types of pads are shown to be configured from pads sized and shaped to be placed in anatomical locations to have the strategically most effective therapeutic benefits. However, those skilled in the art will further appreciate that differently sized, shaped, and configured pads may also be equally effective and desirable. For example, one or more single larger pads may be employed that are adapted to partially or completely wrap around the knee joint, either loosely or snugly, which can be adapted as a sleeve, or which can be sewn into or onto such a sleeve or a snug or loose fitting trouser type garment. The larger type of wrap around pad contemplated can further be preferably adapted with same type of edge taper and generally centered recess contemplated herein with respect to the other illustrated configurations. Even more preferably, the larger pad arrangement may be adapted to be carried on the symptomatic body region either alone, in combination with other clothing articles, or as part of the type of garment or sleeve that is reflected herein.

Further adaptations of any of the preceding embodiments are also within the scope of the instant invention and are reflected in FIGS. 11, 12, 13, and 14. In these illustrative figures, pad 600 is shown being formed to have a generally planar cross section with a complex, compound ovoid shape.

Preferably the pad 600 also defines in interior recess or cutaway 620 positioned to optimize stress relief capability of the pad 600 to address lateral and medial compartment problems of the knee joint K.

As with the preceding embodiments, the pad 600 may also preferably include alignment indicia 640 that can be used to properly align the pad about a garment such as any of the previously described garments. Additionally, the improved pad 600 according to the instant invention may also preferably include one or more generally concave shaped cavities 650 with side edges 655 that are formed about an interior side 660 or an exterior side 665 of the pad 600. The cavity(ies) 650 may also preferably be adapted to have a generally conically diametrical cross-section that diminishes from a superior position 670 to an inferior position 675 so that the pad 600 better conforms to the leg of the patient about the lateral and medial compartments of the knee joint. As with earlier described embodiments, the pad 600 may also incorporate generally tapered exterior edges 680 and interior edges 685 for further stress relief. With these improvements, the weight of the legs of the patient can better be distributed away from the medial or lateral compartments of the knee joint and to surrounding tissues.

Figure 14:
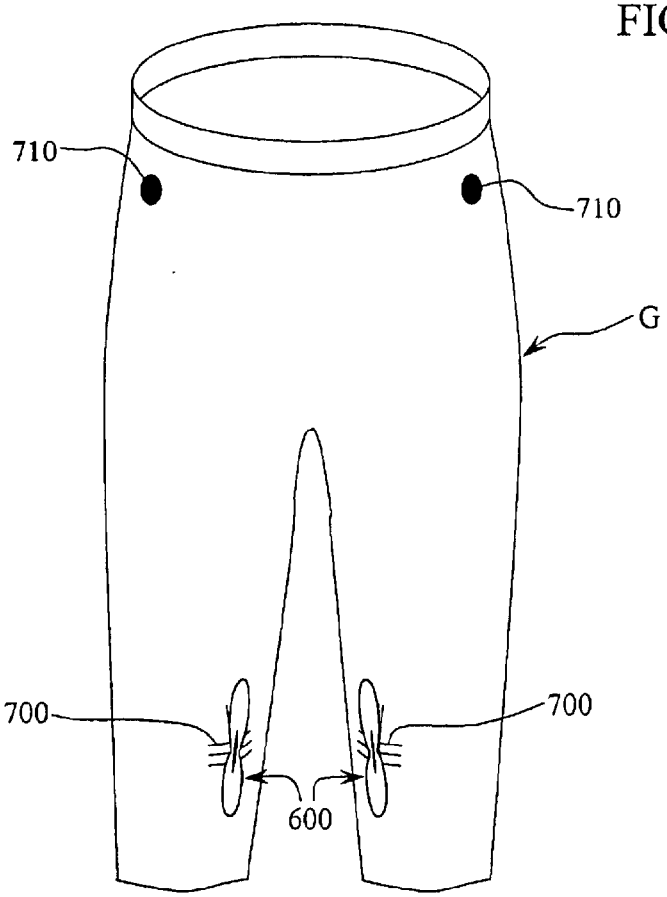
FIG. 14 is an anterior view of an orthopedic rest aid garment according to the principles of the present invention.

With continued reference to the preceding illustrations, and now also to FIG. 14, those skilled in the art can also understand that any of the preceding embodiments of the instant invention may be adapted to function with conventional garments, such as pants and sleep wear, like the garment G schematically depicted in FIG. 14. Although any of a number of the preceding embodiments, variations, modifications, and configurations may be adapted for compatibility in the instant arrangement, pads 600 are shown in an exemplary arrangement to be carried from or attached to garment G. The pads 600 may be attached by any of the previously described and contemplated attachment methods, and are preferably positioned proximate to the region of garment G that will generally be positioned about the knee joint of the patient. Similar configurations are anticipated for hip treatment arrangements. The garment G may also be further adapted to include alignment indicia 700, which can be configured to establish preferred positions for the pads 600 that are proximate to the medial or lateral compartments of the knee joint. Additionally, garment G may also further incorporate positioning and alignment indicia 710, which are preferably positioned to assist the patient in donning the garment G to be properly aligned with easy to locate anatomical locations, such as, for example, the greater trocanter region of the hip.

Although the various FIGS. 11, 12, 13, and 14 reflect another preferred configuration of the invention, these embodiments and variations also further contemplate one or more larger or smaller cushioned pads that are similar in construction to any of the previously described versions, and combination thereof. The larger pad configuration can preferably be configured to completely or partially wrap snugly or loosely around the preferred anatomical location, such as the knee joint, can include the aforementioned central recess and edge tapers, and can be arranged about the body with or without the above described garments.

Each of the preceding embodiments are shown to optionally include indicia for positioning the sleeve or garment on the patient's body, and pads on the garment, so that the combined arrangement can be easily and reproducibly placed about the symptomatic region of the body. However, the instant invention is also directed to any of the preceding embodiments being adapted to incorporate pre-positioned pouches or pockets (not shown) on any of the previously described garment configurations. The contemplated pockets are positioned so that when received with the pads, the previously discussed benefits are achieved. Also, although each of the preceding embodiments are well-suited to applications that involve the direction of a health care provider, any of the preceding embodiments, modification, and variations are equally susceptible to further embodiments directed to the consumer seeking to self-treatment discomfort. Additionally, the present invention also contemplates other types of custom garments not shown in the various figures that include, for example, a snug or loose fitting nylon mesh material, similar in one example to what are known in the art as "panty hose", and which can be adapted to place the preferred pad arrangement proximate to the symptomatic region of the body that is responsible for the discomfort. This variation of any of the preceding embodiments also contemplates further modifications to the "panty hose" that can establish a loose but retained arrangement of the pads near the anatomical location of interest so as to maximize comfort during sleep and convenience during donning and removal of the sleep aid of the instant invention.

More specifically, the preferred sleep aid practiced according to the principles of the instant invention can be further adapted to incorporate pads of multiple predetermined profiles and sizes, and to be configurable by a consumer. More preferably, the consumer may obtain such additional variations with pads that may be configured to any desirable profile. For example, the pads may be fabricated from a material that can be profiled or cut by the consumer to a desired shape with shears or scissors, and to be attached to the aforementioned garments with attachments or pre-positioned pockets. Such further variations may also be sewn directly onto the garment without other attachments or pockets. Pre-shaped pads are also contemplated that can be configured in, for example without limitation, small, medium, large, etc., sizes and shapes so that mass-produced versions of the instant sleep air invention can be configured for wide applicability to various known discomfort causing physical conditions. For further examples, although the sleep aid according to the instant invention is reflected in the preceding description and accompanying figures with pads of various representative dimensions, shapes, and configurations, the instant invention is directed to an even greater collections of such arrangements of pads and garments.

Numerous alterations, modifications, and variations of the preferred embodiments disclosed herein would be apparent to those skilled in the art and they are all contemplated to be within the spirit and scope of the instant invention, which is limited only by the following claims. For example, although specific embodiments have been described in detail, those with skill in the art can understand that the preceding embodiments and variations can be modified to incorporate various types of substitute and/or additional materials, relative arrangement of elements, and dimensional configurations for compatibility with the wide variety of possible garments that are available in the marketplace. Accordingly, even though only few embodiments, alternatives, variations, and modifications of the present invention are described herein, it is to be understood that the practice of such additional modifications and variations and the equivalents thereof, are within the spirit and scope of the invention as defined in the following claims.

I claim:

1. A reconfigurable orthopedic sleep aid, adapted to be worn by a patient about the hips and at least one thigh, comprising:

a garment adapted to substantially surround the hip and at least one thigh and having at least one attachment, the garment also bearing a coordinate indicia pattern and one or more orientation indicia that generally correspond to an anatomical location of the patient selected from the group including a greater trocanter of the hip, a posterior superior iliac crest, a coccyx, and an anterior ventral position medially aligned with the navel, and combinations thereof; and at least one substantially compressible pad having a generally annular profile and a generally toroidal cross sectional profile, the at least one pad configured to be carried from the attachment proximate the greater trochanteric area of the hip of the patient to, when the patient assumes a lateral recumbent position, distribute the weight of the patient away from the greater trocanter and to surrounding tissues, the at least one pad also bearing reference indicia adapted to cooperate with the coordinate indicia pattern to establish at least one placement position on the garment.

2. The reconfigurable orthopedic sleep aid of claim 1, further comprising:

an interior surface of the garment being conformally formed as the at least one attachment.

3. The reconfigurable orthopedic sleep aid of claim 1, wherein the at least one attachment is substantially formed from a dermally comfortable pile material compatible for use as a loop portion of a hook and loop type fastener assembly, and wherein the at least one pad further incorporates a hook portion of the fastener assembly.

4. The reconfigurable orthopedic sleep aid of claim 1, further comprising:

garment edges defining an opening proximate to the perineal region of the patient.

5. The reconfigurable orthopedic sleep aid of claim 1, further comprising:

two substantially compressible pads having a generally annular profile and a generally toroidal cross sectional profile, the pads being configured to be carried from the attachment proximate the respective greater trochanteric areas of the hips.

6. The reconfigurable orthopedic sleep aid of claim 1, wherein the at least one pad is formed with generally tapered edges about inner and outer peripheries.

7. The reconfigurable orthopedic sleep aid of claim 1, wherein the at least one pad is formed to have a generally cycloidal profile that defines an interior recess having a generally elliptical profile.

8. A reconfigurable orthopedic sleep aid, adapted to be worn by a patient about the hips and legs, comprising:

a generally loose fitting trouser garment adapted to be worn by the patient during sleep and having an attachment portion conformally formed on a surface of the garment, the garment also bearing a coordinate indicia pattern and one or more orientation indicia that generally correspond to an anatomical location of the patient selected from the group including a greater trocanter of the hip, a posterior superior iliac crest, a coccyx, and an anterior ventral position medially aligned with the navel, and combinations thereof; and at least one substantially compressible pad having a generally annular profile and a generally toroidal cross sectional profile, the at least one pad configured to be carried from the attachment portion proximate the greater trochanteric area of the hip of the patient to, when the patient assumes a lateral recumbent position, distribute the weight of the patient away from the greater trocanter and to surrounding tissues, the at least one pad also bearing reference indicia adapted to cooperate with the coordinate indicia pattern to establish at least one placement position on the garment.

9. A reconfigurable orthopedic sleep aid, adapted to be worn by a patient about the hips and at least one thigh, comprising:

a garment adapted to substantially surround the hip and at least one thigh and having at least one attachment, the garment also bearing a coordinate indicia pattern and one or more orientation indicia that generally correspond to an anatomical location of the patient selected from the group including a greater trocanter of the hip, a posterior superior iliac crest, a coccyx, and an anterior ventral position medially aligned with the navel, and combinations thereof; and at least one generally wedge shaped substantially compressible pad configured to be carried from the attachment proximate the gluteal fold of the patient to, when the patient assumes a supine recumbent position, effect posterior tilt of the pelvis to decrease the lordotic position of the back, the at least one wedge also bearing reference indicia adapted to cooperate with the coordinate indicia pattern to establish at least one placement position on the garment.

10. The reconfigurable orthopedic sleep aid of claim 9, further comprising:

an interior surface of the garment being conformally formed as the at least one attachment.

11. The reconfigurable orthopedic sleep aid of claim 9, wherein the at least one attachment is substantially formed from a dermally comfortable pile material compatible for use as a loop portion of a hook and loop type fastener assembly, and wherein the at least one wedge further incorporates a hook portion of the fastener assembly.

12. The reconfigurable orthopedic sleep aid of claim 9, further comprising:

garment edges defining an opening proximate to the perineal region of the patient.

13. The reconfigurable orthopedic sleep aid of claim 9, further comprising:

two generally wedge shaped substantially compressible pads adapted to be carried from the garment proximate the respective gluteal folds.

14. A reconfigurable orthopedic sleep aid, adapted to be worn by a patient about the hips and legs, comprising:

a generally loose fitting trouser garment adapted to be worn by the patient during sleep and having an attachment portion conformally formed on a surface of the garment, the garment also bearing a coordinate indicia pattern and one or more orientation indicia that generally correspond to an anatomical location of the patient selected from the group including a greater trocanter of the hip, a posterior superior iliac crest, a coccyx, and an anterior ventral position medially aligned with the navel, and combinations thereof; and at least one wedge shaped substantially compressible pad configured to be carried from the attachment portion proximate to at least one respective posterior thigh of the patient to, when the patient assumes a supine recumbent position, effect posterior tilt of the pelvis to decrease the lordotic position of the back, the at least one wedge also bearing reference indicia adapted to cooperate with the coordinate indicia pattern to establish at least one placement position on the garment.

15. The reconfigurable orthopedic sleep aid of claim 14, wherein the at least one attachment is substantially formed from a dermally comfortable pile material compatible for use as a loop portion of a hook and loop type fastener assembly, and wherein the wedges further incorporate a hook portion of the fastener assembly.

16. The reconfigurable orthopedic sleep aid of claim 14, wherein the attachment portion is conformally formed about an interior surface of the trouser garment.

17. A reconfigurable orthopedic sleep aid, adapted to be worn by a patient about a knee joint, comprising:

a garment adapted to substantially conform to and surround the knee joint and having at least one attachment, the garment also bearing a coordinate indicia pattern and one or more orientation indicia that generally correspond to an anatomical location of the patient selected from the group including a medial and a lateral border of the patella, a lateral and a medial compartment of a respective inferior and superior knee joint, and a hamstring tendon of the knee joint, and combinations thereof; and at least one substantially compressible pad having a generally annular profile and a generally toroidal cross sectional profile, the at least one pad configured to be carried from the attachment proximate a medio-lateral aspect of the knee joint to, when the patient assumes a lateral recumbent position, distribute the weight of the patient away from the medio-lateral aspect and to surrounding tissues, the at least one pad also bearing reference indicia adapted to cooperate with the coordinate indicia pattern to establish at least one placement position on the garment.

18. The reconfigurable orthopedic sleep aid of claim 17, further comprising:

an interior surface of the garment being conformally formed as the at least one attachment.

19. The reconfigurable orthopedic sleep aid of claim 17, wherein the at least one attachment is substantially formed from a dermally comfortable pile material compatible for use as a loop portion of a hook and loop type fastener assembly, and wherein the at least one pad further incorporates a hook portion of the fastener assembly.

20. The reconfigurable orthopedic sleep aid of claim 17, wherein the at least one pad is formed with generally tapered edges about inner and outer peripheries.

* * * * *